United States Patent [19]

Svenäng

[11] 4,404,788

[45] Sep. 20, 1983

[54] PACKAGING MACHINE

[75] Inventor: Jan T. Svenäng, Gothenburg, Sweden

[73] Assignee: Tex Innovation AB, Frölunda, Sweden

[21] Appl. No.: 241,347

[22] Filed: Mar. 6, 1981

[51] Int. Cl.[3] ..... B65B 31/06

[52] U.S. Cl. ..... 53/512; 53/386; 53/405

[58] Field of Search ..... 53/512, 510, 434, 405, 53/390, 386

[56] References Cited

U.S. PATENT DOCUMENTS

| | | | |
|---|---|---|---|
| 3,289,387 | 12/1966 | Stagmeier et al. | 53/512 |
| 3,499,261 | 3/1970 | Hullhorst et al. | 53/512 X |
| 3,508,375 | 4/1970 | Myers | 53/512 |
| 3,866,390 | 2/1975 | Moreland et al. | 53/512 X |
| 3,939,624 | 2/1976 | Gidewall et al. | 53/386 X |
| 3,965,652 | 6/1976 | Cimins | 53/386 X |
| 4,221,101 | 9/1980 | Woods | 53/512 X |
| 4,241,558 | 12/1980 | Gidewall et al. | 53/512 X |
| 4,292,786 | 10/1981 | Long et al. | 53/512 X |

*Primary Examiner*—James F. Coan

*Attorney, Agent, or Firm*—Lawrence I. Field

[57] ABSTRACT

This invention provides an apparatus for over-wrapping or bulk packaging of commodities on a pallet or the like supporting surface. The apparatus comprises a supporting surface on which commodities are adapted to be over-wrapped or bulk packaged with a sealable flexible wrapping material, a movable enclosure surrounding the supporting surface and forming an open-topped chamber with said supporting surface. The aforesaid chamber is adapted to receive flexible packaging material, and the movable enclosure is movable relative to the supporting surface to permit access to the supporting surface. Means for gripping and engaging opposed portions of the flexible wrapping material are provided as are means for evacuating air from the flexible wrapping material after the commodities have been inserted therein. Means are also provided for sealing the flexible wrapping material in said chamber to form a seal across the wrapping material.

13 Claims, 11 Drawing Figures

PACKAGING MACHINE

This invention relates to an apparatus.

More particularly, this invention relates to an apparatus for over-wrapping commodities or in other words, bulk packaging commodities in a flexible wrapping material.

When various commodities are manufactured, such as individual items in the form of garments, textile products such as blankets, etc., they are normally wrapped individually; to this end, vacuum packaging has become more frequent for such commodities, particularly where the commodities are manufactured in other countries and imported. For the sake of convenience, it is more desirable to transport a plurality of commodities in one bigger package and preferably, they are mounted on a pallet for easy shipping.

With this invention, applicant has developed an apparatus for packaging a plurality of commodities in a flexible wrapping material such as a bag of plastic material, which apparatus comprises a supporting surface on which the commodities are adapted to be over-wrapped or bulk packaged with a sealable flexible wrapping material, a movable enclosure surrounding the supporting surface and forming an open-topped chamber with said supporting surface, the chamber being adapted to receive the flexible packaging material therein, the movable enclosure being movable relative to the supporting surface to permit access to the supporting surface, means for gripping and engaging opposed portions of the flexible wrapping material, means for evacuating air from the flexible wrapping material after commodities have been inserted therein, and means for sealing the flexible wrapping material in the chamber after air has been evacuated therefrom.

In preferred embodiments of the invention, the flexible wrapping material may be a flexible bag of plastic material having opposed side walls and an open end for insertion of a commodity therein. The enclosure may be a walled enclosure having an open top and open bottom surrounding the supporting surface. A further preferred embodiment of the invention is wherein the supporting surface is a pallet. The pallet may be mounted on a movable frame assembly movable vertically between first and second positions, and the movable frame assembly may include means for raising and lowering the assembly with a pallet thereon between first and second positions. Another embodiment of the invention contemplates the gripping and engaging means comprising a movable gripping head movable between a first non-engaging position and a second flexible wrapper engaging position, the movable head including sealing means for sealing the flexible wrapping material at the second position.

In other preferred embodiments of the invention, the flexible wrapping material in the form of a flexible bag of plastic film or the like may be provided with a conventional vacuum valve in the bag; according to this embodiment, the overwrap bag is initially loaded or charged with commodities, either wrapped or unwrapped, and subsequently the bag is sealed as described above and hereinafter with respect to the drawings. Then, a suction source is connected to the vacuum valve which otherwise forms an integral part or is fixedly secured to the overwrap bag and the air evacuated from the bag.

In the above noted embodiment, any suitable conventional vacuum valve may be incorporated into the bag structure; such vacuum valves are known in the art and they may be fixedly secured to the bag by e.g. heat sealing or the like. Alternatively, they may be molded into the overwrap bag. In operation, a pallet of any conventional construction and size may be inserted into the chamber defined by the movable enclosure; an open-topped flexible bag preferably of plastic material is inserted into the chamber to sit on the pallet and thereafter, commodities are charged into the bag with the supporting surface on which the pallet rests being raised as required and/or lowered as required for ease of loading purposes. After the overwrapped bag is filled, the open-topped portion of the overwrapped bag is aligned so that the pair of opposed sides of the overwrap bag are placed in the gripping means and the gripping means is effective to place tension on the open mouth of the bag so as to align both sides of the open mouth; in one embodiment, the bag is filled and in that embodiment, the bag is provided with a vacuum valve whereafter the air is evacuated from the bag. In a further embodiment, the air is evacuated from the bag and thereafter the open-top portion sealed to provide a vacuum packaged product.

The gripping and vacuum assembly, the latter according to one embodiment of the invention, preferably comprises a pair of spaced apart sealing heads; the sealing heads may be of any conventional construction and normally comprises a pair of sealing elements spaced in operative relationship to each other; the sealing heads may be brought together by suitable means—e.g. a hydraulic or pneumatic cylinder. The vacuum assembly preferably includes, in the embodiment where the assembly is used, a vacuum or suction head which inserted by means of, for example, a pneumatic cylinder into the mouth of the bag prior to sealing; the air is evacuated from the bag and subsequently before the sealing the vacuum mouth is withdrawn from the bag.

The various components of the apparatus may be operated in time-related sequence by appropriate limits. Thus, upon filling a bag with a commodity, the subsequent operations can be performed in sequence using pre-programmed steps as desired.

It will be appreciated in the case where the overwrap bag includes a vacuum valve, in place of the suction head, an appropriate vacuum or suction conduit may be employed for connection to the vacuum valve bag; this may either be done manually or by a modified apparatus as subsequently described herein. Still further, if desired, the present apparatus may be employed in conjunction with a loading apparatus for inserting commodities into a bag whereby an automatic operation may be employed.

Having thus generally described the invention, reference will now be made to the accompanying drawings in which.

Figure 10:
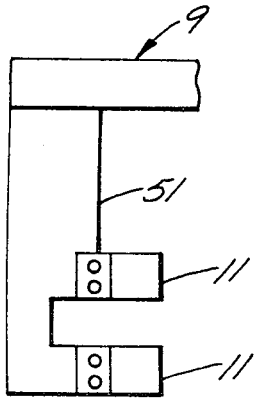
Figure 11:
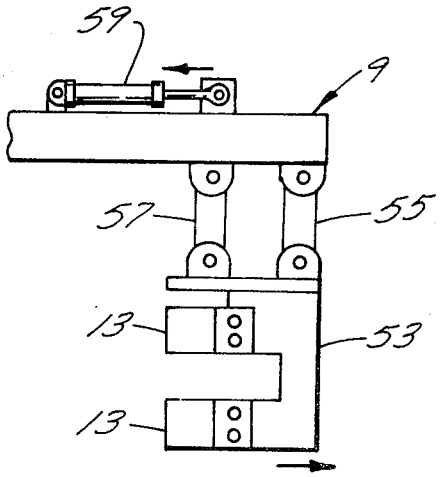
Figure 3:
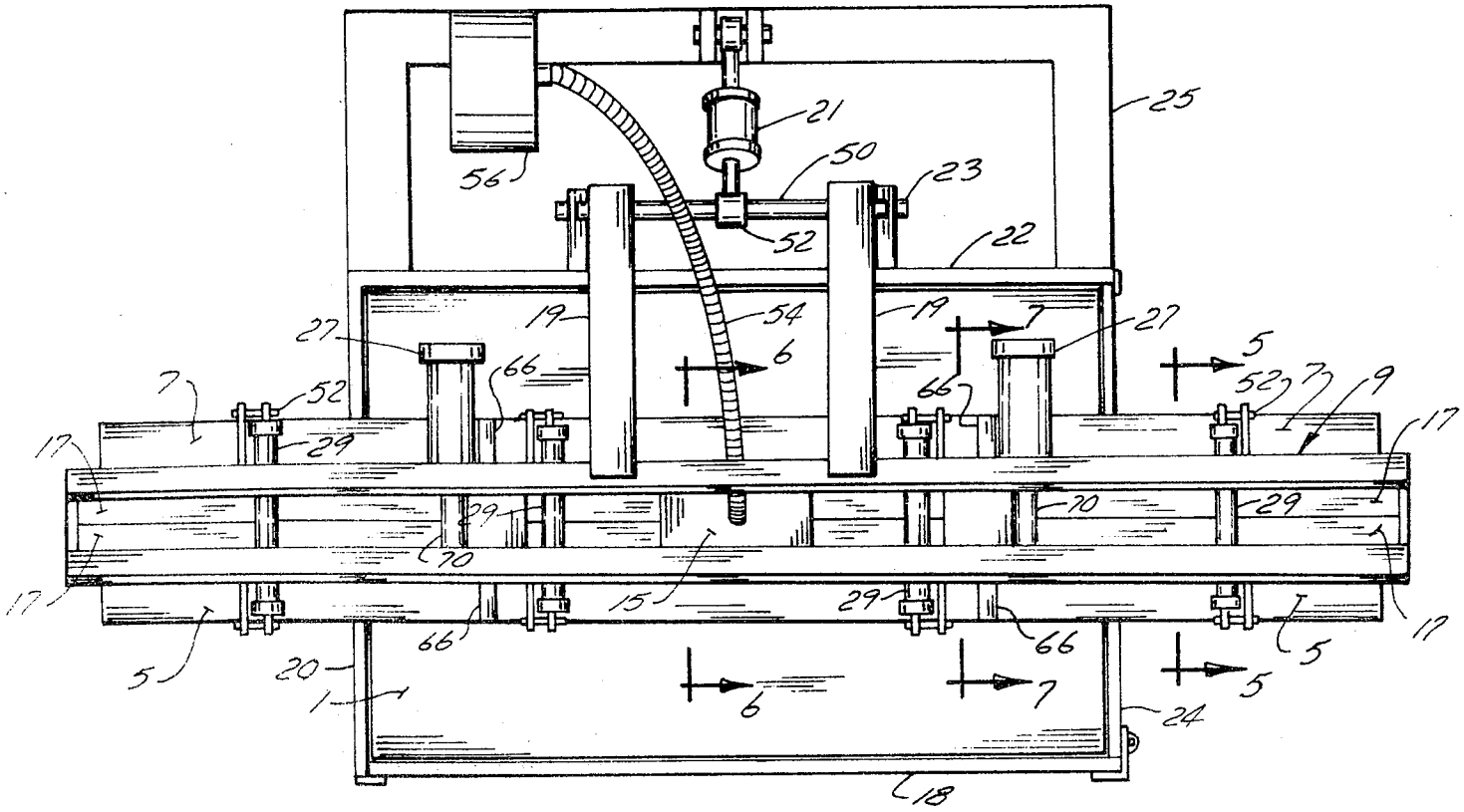
FIG. 3 is a top plan view of the apparatus.
Figure 5:
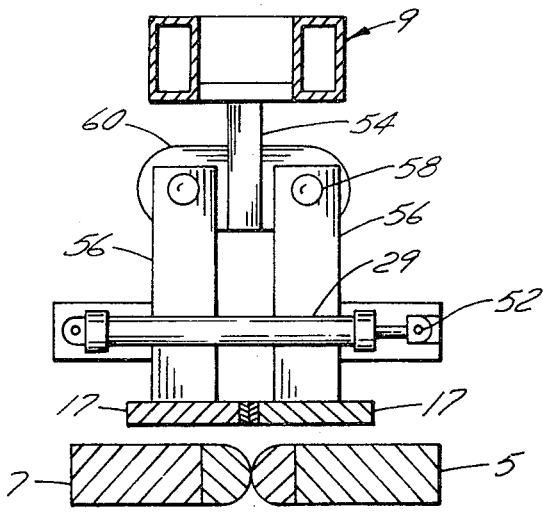
Figure 6:
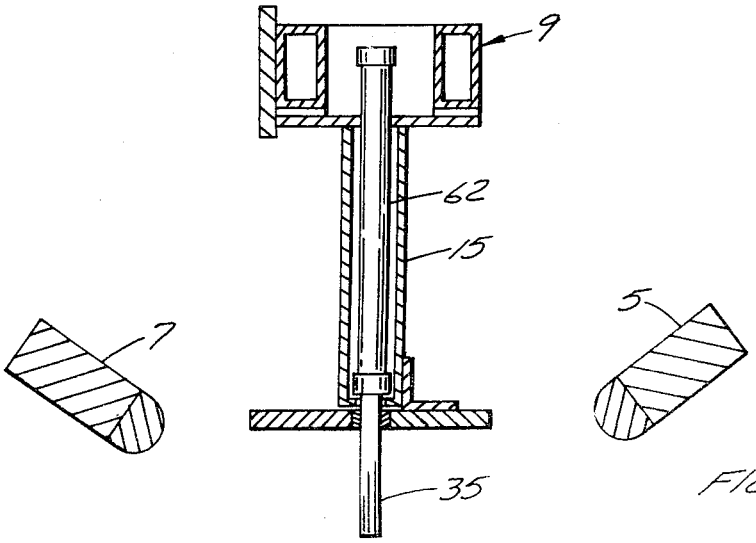
Figure 7:
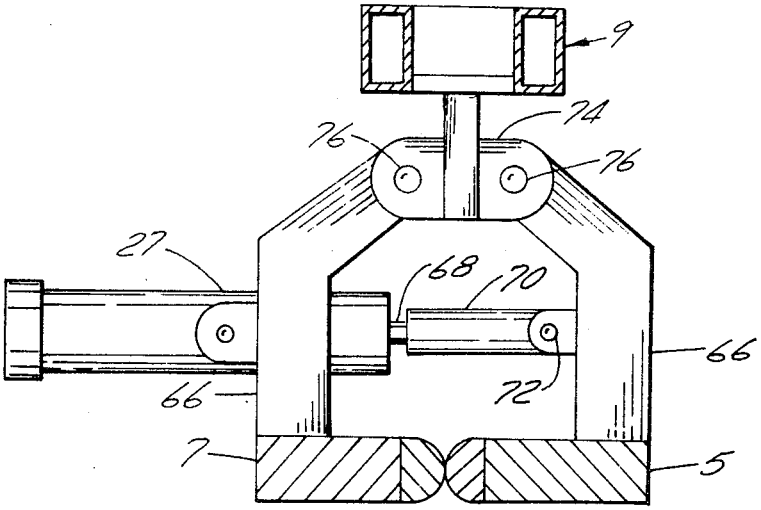
Figure 8:
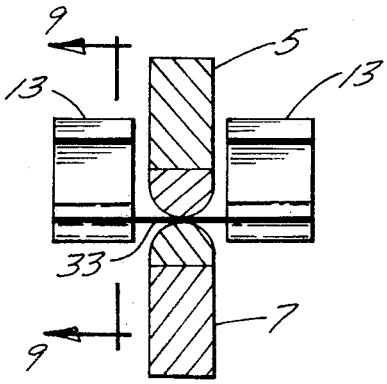
Figure 9:
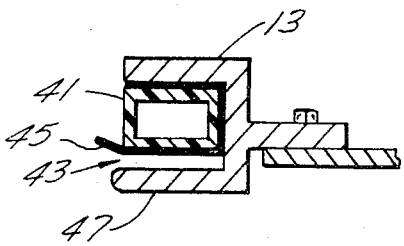

FIGS. 5, 6 and 7 are cross sectional views of the top frame and associated apparatus taken along section lines 5, 6 and 7 in FIG. 3;

FIG. 8 is an end elevation view of one set of clamp members showing their relation to the sealing head;

FIG. 9 is a cross section view of one of the clamp members taken along line 9 of FIG. 8;

FIG. 10 is a detail plan view of one end of the top frame showing the clamping members at that end; and FIG. 11 is a detail plan view of the other end of the frame member showing the clamping members at that end.

Figure 1:
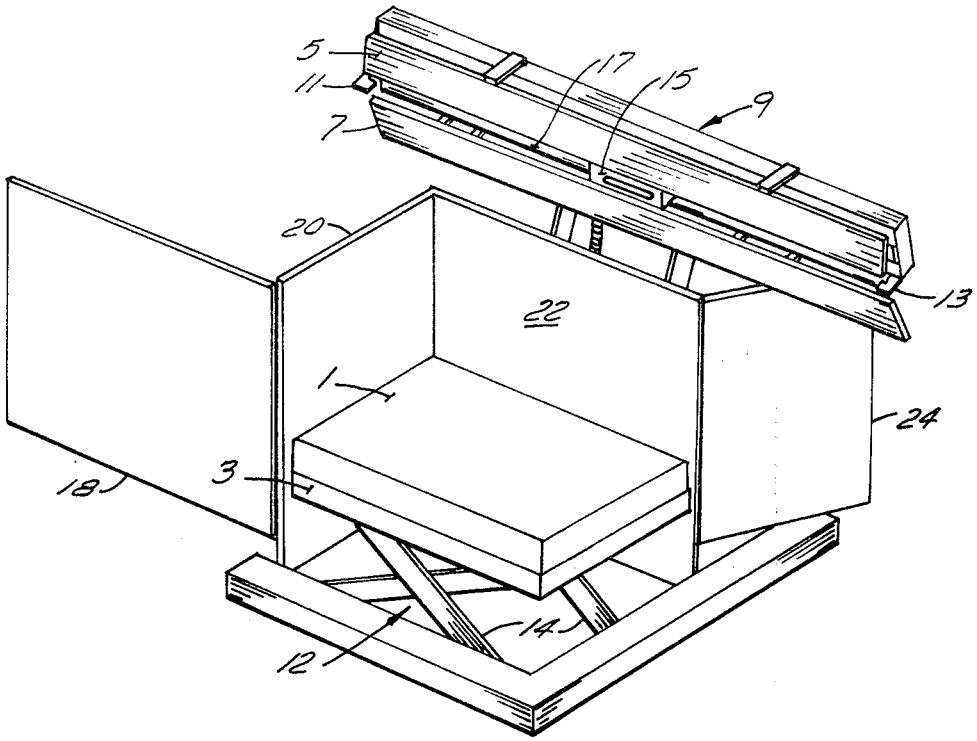
FIG. 1 is a perspective view of the apparatus with the doors open showing the loading platform and the pallet.

Referring now to FIG. 1, one form of the apparatus is shown in which a pallet 1 is shown positioned on a supporting table 3. The supporting table 3 is mounted on a movable frame assembly indicated generally by reference numeral 12 and which comprises a pair of opposed cross braces 14; the supporting table 3 is movable between upper and lower positions and is raised and lowered by means of a cylinder (not shown) which may either be hydraulic, pneumatic or the like.

The apparatus includes a housing or chamber comprised of, in the case illustrated, four panels, 18, 20, 22 and 24, panels 18 and 24 being hingably connected to panels 20 and 22 respectively and being adapted to, in their closed position, to form a housing around the supporting table 3. In their open position, as illustrated in FIG. 1, they are adapted to provide access to table 3 or in other words, the interior of the chamber.

For loading purposes, and for ease of operation during use, as outlined above, the supporting table 3 is movable between upper and lower positions. The table 3 operated between the upper and lower positions, or in increments therebetween, preferably as upper and lower conventional position detecting means—e.g. photocells or the like, to set the upper and lower limits of the supporting platform 3. Manual means may be provided for actuating the cylinder for movement of the supporting platform 3 to intermittently move the same between the upper and lower positions.

For most usage, the apparatus will normally be initially employed with the supporting table 3 in its uppermost position; when the chamber defined by the panels 18, 20, 22 and 24 is closed, a bag of flexible wrapping material such as heat sealable plastic material, is inserted into the chamber defined by the walls and the supporting surface or table 3, and the bag is loaded with prepackaged or non-packaged commodities. During the course of loading, for ease of loading, the supporting table 3 may be lowered as desired upon actuation of the manual system described above.

Prior to placing of the plastic bag in the chamber, and preferably prior to closing of the doors or walls 18 and 24, a pallet indicated by reference numeral 1 is inserted on the supporting table 3. Thus, in accordance with this development, the pallet 1 forms the base upon which the flexible wrapping material is placed for loading the commodities.

The apparatus as illustrated in the drawings also includes a gripping and sealing device or assembly; reference numerals 5 and 7 designate the sealing heads of this assembly which are carried by a top frame 9. The gripping assembly includes a pair of opposed end clamps as indicated by reference numerals 11 and 13, which will be described hereinafter in greater detail. The assembly also includes a housing 15 for a vacuum or suction nozzle and as will be seen from FIG. 1, reference numeral 17 designates a longitudinal clamp.

Figure 2:
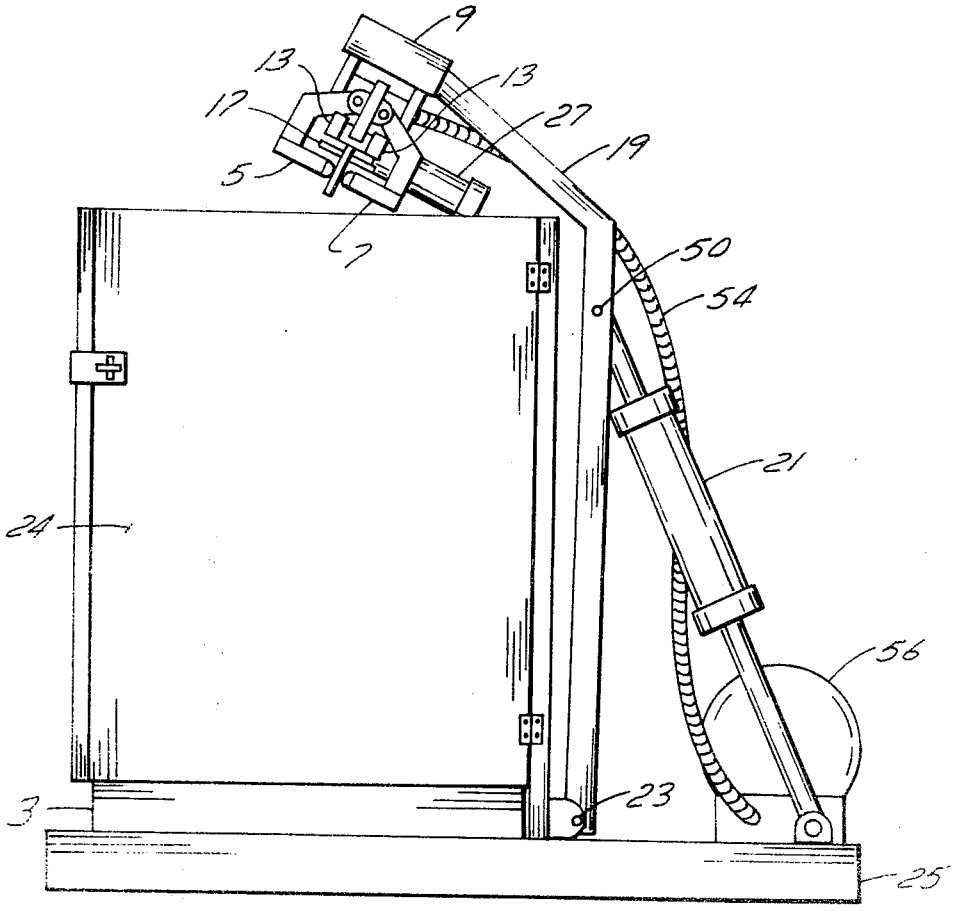
FIG. 2 is a side elevation view of the apparatus with the doors closed.

Referring to FIG. 2, the upper frame 9 is illustrated in greater detail in this figure and in other following figures; as will be noted, there is provided a frame 19 by which the top frame is moved between operative and inoperative positions by means of a cylinder assembly 21. The support frame 19 is pivoted at the bottom as indicated by reference numeral 23, where it is connected to the main frame 25 of the apparatus. As shown in FIG. 2, the sealing bars are in a "closed" position, actuated by means of a hydraulic cylinder 27 which functions to open and close the sealing heads as required, for sealing the plastic wrapping material as described hereinafter.

Referring now to FIG. 3, the upper frame 9 is illustrated in greater detail and is shown as being connected to the pivoted supporting frame 19. Pivoted supporting frame 19, as illustrated in FIG. 3, comprises a pair of spaced apart frame members joined by means of a cross-member 50, which in turn, is journalled about a bushing 52 connected to the piston assembly 21. As illustrated in FIG. 3, beneath the center of the top frame, the longitudinal clamp member 17 is shown, and beneath the clamp member 17 are the sealing heads 5 and 7. Hydraulic cylinders 29 are provided for moving the longitudinal clamping members including member 17 together—in the embodiment illustrated, there are four such hydraulic cylinders.

The apparatus also includes a central suction housing indicated generally by reference numeral 15, which is connected by means of a hose 54 to a suction or vacuum pump 56.

Figure 4:
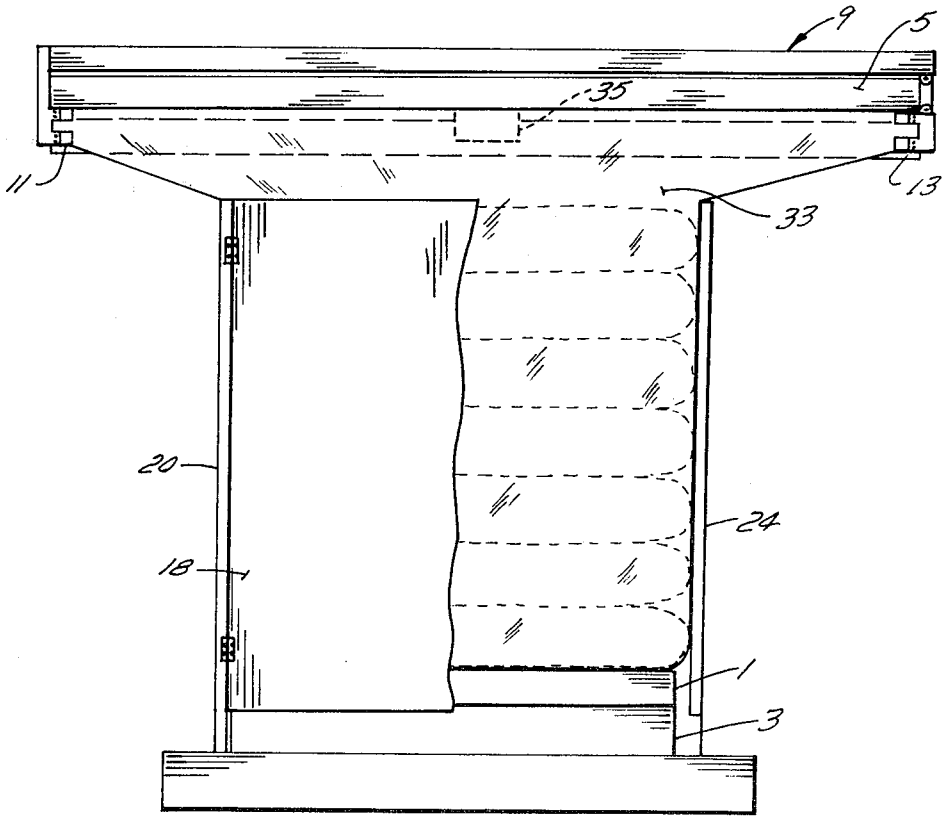
FIG. 4 is a front elevation view of the apparatus with a portion of the front door panel removed to show the interior of the container.

In FIG. 4, illustrating the apparatus with a portion of the front panel removed for better clarity, a plastic bag is shown as having been inserted into the chamber, which plastic bag is indicated generally by reference numeral 33. As will be seen from FIG. 4, the plastic bag 33 is gripped and held by the end gripping members 11 and 13 after having been inserted in the clamps-i.e. the side edges of a plastic bag is placed between the clamp members which serve to grip the packaging material, as well as the other gripping members as illustrated in FIG. 2, after the plastic bag has been loaded with commodities.

The apparatus with the suction assembly and which includes a suction head 35, is then actuated with the suction head 35 placed inside the mouth of the bag, so as to withdraw air from the bag.

Referring now to FIGS. 5 et seq., the clamping means are shown in greater detail together with the sealing head members 5 and 7. The remaining upper frame 9 has a supporting member 54 connected thereto, which in turn, mounts a pair of spaced apart arms 56 pivotably journalled by means of pins 58 on a cross member 60, which in turn, is connected to the support member 54. As seen in FIG. 6, illustrating cross sectional view through the housing 15, the means for moving the suction nozzle 35 is shown in greater detail; to this end, there is provided a cylinder assembly 62 mounting the suction head 35 which is adapted to move the suction head or nozzle into and out of position. As illustrated in FIG. 6, the sealing bars 5 are shown in their inoperative position—i.e. displaced to permit the sealing head 35 to enter into the mouth of the bag when the same is placed on the gripping means.

The mechanism for moving the sealing bars 5 and 7 together is illustrated in FIG. 7, and this comprises a hydraulic or pneumatic cylinder 27 connected to a pair of spaced apart supporting members 66; one of the members 66 being fixedly secured to the cylinder 27 while the other member is fixedly secured to the piston rod of the cylinder 27. Thus, the piston rod 68 mounts a bracket 70 which is pivotably attached to a further bracket 72 connected to the member 66. Members 66 are connected, at their upper end, to a further fixed bracket 74 by means of a pivot 76.

In FIG. 8, the clamp members 13 are illustrated in greater detail and are shown operating in conjunction with the sealing bars 5 and 7. As shown in FIG. 8, the clamping members are effective to grip the mouth of the bag while permitting the sealing heads 5 and 7 to seal the mouth of the bag. In FIG. 9, illustrating a cross sectional view of one of the clamp members, it will be noted that the clamping members operate by means of clamping the bag in a slot 43 by pushing a plate member 45 down against the bottom flange 47 of the clamp member. In FIG. 10, the clamp members 11 on the left hand end of the machine, as shown in FIG. 1, are mounted by means of a plate member 51 to the frame 9 of the machine. The clamp members 13 at the other end of the machine are movable as indicated by the arrow; these clamp members are fixed to a plate 53 connected to the frame by parallelogram linkage 55, one arm of the parallelogram linkage 57 being extended to be operated by a cylinder 59.

In operation, after a pallet is inserted onto the supporting surface 3, the supporting surface 3 being raised or lowered to the desired position, a bag is inserted into the chamber defined by the container walls and the bag loaded with the desired commodities. After filling of the overwrapping bag, the mouth of the bag is positioned by the gripping members of the gripping assembly described above, the air is removed by the suction means described above and the mouth of the bag subsequently sealed. Thereafter, the pallet containing the sealed bag is unloaded and the operation repeated.

It will be appreciated that various types of supporting surfaces may be employed with this invention; preferred are pallets due to their wide usage in commerce, and any type of pallet may be used for that purpose.

It will also be understood that modifications can be made to the above-described embodiments without departing from the spirit and scope of the invention. Thus, for example, automatic loading rather than manual loading may be carried out for inserting commodities into the overwrapping material or bag, and the complete operation of the device from insertion of the commodity into the over-wrapping material may be carried out in a time-related sequence as desired.

I claim:

1. An apparatus for over-wrapping or bulk packaging of commodities on a pallet or the like supporting surface comprising a supporting surface on which said commodities are adapted to be over-wrapped or bulk packaged with a sealable flexible wrapping material having a vacuum valve therein, a movable enclosure surrounding the supporting surface and forming an open-topped chamber with said supporting surface, said chamber being adapted to receive said flexible packaging material therein, said movable enclosure being movable relative to said supporting surface to permit access to said supporting surface, means for gripping and engaging opposed portions of said flexible wrapping material, means for evacuating air from the flexible wrapping material after commodities have been inserted therein, and means for sealing the flexible wrapping material in said chamber to form a seal across the wrapping material, said means for sealing the flexible wrapping material being effective to seal the wrapping material prior to said means for evacuating air from the flexible material evacuating said air from said material through said vacuum valve means.

2. An apparatus as defined in claim 1, wherein said flexible wrapping material is a flexible bag of plastic material having opposed side walls and an open end for insertion of a commodity therein.

3. An apparatus as defined in claim 1, wherein said enclosure comprises a walled enclosure having an open top and open bottom surrounding said supporting surface.

4. An apparatus as defined in claim 3, wherein said supporting surface is a pallet.

5. An apparatus as defined in claim 4, wherein said pallet is mounted on a movable frame assembly movable vertically between first and second positions.

6. An apparatus as defined in claim 5, wherein said movable frame assembly includes means for raising and lowering said assembly with a pallet thereon between first and second positions.

7. An apparatus as defined in claim 1, wherein said gripping and engaging means comprises a movable gripping head movable between a first non-engaging position and a second flexible wrapper engaging position, said movable head including sealing means for sealing the flexible wrapping material at said second position.

8. An apparatus defined in claim 7, wherein said gripping and engaging means comprises a pair of spaced apart gripping members, at least one of said members being adapted to axially move relative to the other of said gripping member, and wherein said sealing means comprises a pair of spaced apart sealing heads.

9. An apparatus for over-wrapping or bulk packaging of commodities on a pallet or the like supporting surface comprising a supporting surface on which commodities are adapted to be over-wrapped or bulk packaged with a sealable bag of flexible wrapping material, a movable loading enclosure surrounding the supporting surface and forming an open-top chamber with said supporting surface, said movable loading enclosure being adapted to receive the bag of flexible packaging material therein and having at least one movable side member movable relative to said supporting surface to permit access to said supporting surface when side member is in an open position, movable gripping means for gripping and engaging opposed side portions of said bag of flexible wrapping material to place a mouth portion of said bag in a sealable position, means for moving said gripping means into and out of a bag engaging relationship, means for evacuating air from said bag of flexible wrapping material after commodities have been inserted therein, means for sealing said bag of flexible wrapping material in said chamber to form a seal across the open mouth of the bag of wrapping material, and means for operating said gripping means, said means for evacuating air from the bag of flexible material and said sealing means in time-related sequence whereby said gripping means grips the opening mouth of a bag, said means evacuates air from the bag of flexible wrapping material, and said sealing means seals the bag of flexible material across the open mouth.

10. An apparatus as defined in claim 9, wherein said means for evacuating air comprises vacuum or suction means adapted to be inserted into the open mouth of a flexible bag, means for inserting and removing said means for evacuating air into and out of a bag mouth, and wherein said means for sealing the flexible wrapping material is operated in timed-relationship to said means for evacuating air to seal the open mouth of flexible wrapping material after said means for evacuating air has evacuated air from the overwrap material.

11. An apparatus as defined in claim 9, wherein said supporting surface is a pallet.

12. An apparatus as defined in claim 9, wherein said pallet is mounted on a movable frame assembly movable vertically between first and second positions.

13. An apparatus as defined in claim 9, wherein said gripping and engaging means comprises a pair of spaced apart gripping members, at least one of said members being adapted to axially move relative to the other of said gripping member, and wherein said sealing means comprises a pair of spaced apart sealing heads.

* * * * *